US005131240A

United States Patent [19]

Kohashi et al.

[11] Patent Number: 5,131,240

[45] Date of Patent: Jul. 21, 1992

[54] AIR CONDITIONING APPARATUS

[75] Inventors: Masao Kohashi; Ken-ichi Azuma, both of Amagasaki; Kentaro Mori, Shizuoka, all of Japan

[73] Assignee: Mitsubishi Denki Kabushiki Kaisha, Tokyo, Japan

[21] Appl. No.: 723,680

[22] Filed: Jun. 27, 1991

Related U.S. Application Data

[63] Continuation of Ser. No. 601,017, Oct. 22, 1990, abandoned, which is a continuation of Ser. No. 447,538, Dec. 7, 1989, abandoned.

[30] Foreign Application Priority Data

Dec. 23, 1988 [JP] Japan ..... 63-325266
Aug. 31, 1989 [JP] Japan ..... 1-225827

[51] Int. Cl.[5] ..... F25B 13/00
[52] U.S. Cl. ..... 62/324.1
[58] Field of Search ..... 62/324.1

[56] References Cited

U.S. PATENT DOCUMENTS 2,828,767 4/1958 Barusch ..... 62/324.1 X
3,196,896 7/1965 Leutenegger ..... 137/271
3,303,665 2/1967 Ray ..... 62/324.1
4,313,314 2/1982 Boyanich ..... 62/324.1
4,573,497 3/1986 White ..... 62/324.1 X
4,709,554 12/1987 Umemura et al. ..... 62/156

FOREIGN PATENT DOCUMENTS 60-114673 6/1985 Japan .

*Primary Examiner*—William E. Tapolcai
*Attorney, Agent, or Firm*—Oblon, Spivak, McClelland, Maier & Neustadt

[57] ABSTRACT

An air conditioning apparatus includes a pipe unit in the form of a block-like member, the pipe unit comprising: control components, like a four port valve, a two port valve and a check valve, of the refrigerating cycle, which are incorporated in the block-like member; refrigerant passages which are formed in the block-like member to lead to the control components; and connecting ports which are formed in the block-like member to be connected to essential components, like a compressor, and an indoor and an outdoor heat exchanger, of the refrigerating cycle.

7 Claims, 8 Drawing Sheets

AIR CONDITIONING APPARATUS

This application is a continuation of application Ser. No. 07/601,017, filed on Oct. 22, 1991, now abandoned, which is a continuation of application Ser. No. 07/447,538, filed on Dec. 7, 1989, now abandoned.

BACKGROUND OF THE INVENTION

FIELD OF THE INVENTION

The present invention relates to air conditioning apparatus, and is more particularly concerned with simplification of refrigerant pipes in the refrigerating cycle in the apparatus.

DISCUSSION OF BACKGROUND

In general, such type of air conditioning apparatus uses refrigerant pipes 9 to connect a compressor, an outdoor heat exchanger 2 and an indoor heat exchanger 3 which are the essential components of the refrigerating cycle, and a four port valve 4, a two port valve 5, a decompression device 6, a check valve 7 and a capillary tube 8 which are control components of the refrigerating cycle, as shown in FIG. 13, constituting the whole refrigerating cycle. Switching the four port valve 4 allows the air conditioning apparatus to selectively carry out room cooling and room heating.

The air conditioning apparatus is divided into an outdoor unit A and an indoor unit B as shown in FIG. 13. A refrigerant pipe 9*a* in the outdoor unit A is connected to a refrigerant pipe 9*b* in the indoor unit B through a connector 10. The flow of a refrigerant on cooling is indicated in arrows of solid line, whereas the flow of the refrigerant on heating is indicated in arrows of dotted line.

In the outdoor unit A of the air conditioning apparatus, the refrigerant pipes 9 which are used to connect the compressor 1 and the outdoor heat exchanger 2 as the essential components of the refrigerating cycle, and the four port valve 4, the two port valve 5, the decompression device 6, the check valve 7 and the capillary tube 8 as the control components of the refrigerating cycle are arranged the way pipes are bent in various directions as shown in FIG. 14, the check valve and the capillary tube serving to prevent the refrigerant from flowing backwards to the four port valve or the two port valve 5. The connection between the essential components and the refrigerant pipes, and the connection between the control components and the refrigerant pipes are made by e.g. brazing.

In the use of the apparatus of FIG. 13 in a room warming operation (flow along dotted line arrows), a high-temperature, high-pressure refrigerant gas compressed in the compressor 1 is supplied through the four-port valve 4 to the indoor heat exchanger 3 where it is condensed while warming the room. The refrigerant liquid then flows to the decompression device 6 where it is subjected to pressure reduction, and so evaporates in the outdoor side heat exchanger 2. The refrigerant gas is then returned to the compressor 1 through the four-port valve 4. The refrigerant does not reach the capillary tube 8 since the two-port valve 5 is closed.

When atmospheric temperature decreases, the evaporation temperature for the refrigerant in the outdoor side heat exchanger 2 decreases to become a dew point temperature or lower, whereby deposition of frost in the outdoor side heat exchanger 2 begins. Accordingly, the temperature of the outdoor side heat exchanger 2 decreases. When the temperature decreases to a predetermined temperature or lower, a defrosting operation is started in which the two-port valve 5 is repeatedly opened and closed for a predetermined time at fixed intervals, after which it is opened. The two-port valve 5 thus relieves a sudden change of pressure when operation is switched from the room warming operation to the defrosting operation, and allows the high-temperature, high-pressure refrigerant gas compressed in the compressor 1 to be set to the capillary tube 8 and check valve 7. The refrigerant passing the check valve 7 is directly supplied to the outdoor side heat exchanger 2 to dissolve the frost while the refrigerant is condensed. The condensed refrigerant is mixed with the high-temperature, high-pressure refrigerant gas which is forwarded through the capillary tube 8. Then, the refrigerant becomes a saturated gas downstream of the four-port valve 4, and finally is sucked back into the compressor 1. Accordingly, a high pressure condition in the room warming operation is maintained and warm air can be supplied in the room even in the defrosting operation.

In a cooling operation, the four-port valve is moved to the solid line position in FIG. 13 (flow in direction of solid line arrows), so that gaseous refrigerant from the compressor 1 is delivered to the outdoor side heat exchanger 2, via the four-port valve 4, for condensation. The condensed refrigerant is expanded in the decompression device (expansion valve) 6, and condensed in the indoor side heat exchanger 3, in a well known manner.

The various valves are controlled by a controller (not shown) which changes the states of the four-port valve 4 and the two-port valve 5 in a well known fashion, for example as shown in U.S. Pat. No. 3,196,896 in order to provide the above operations.

Because the conventional air conditioning apparatus uses the refrigerant pipes to make every connection between the essential components, between the control components, and between the essential components and the control components, many kinds of refrigerant pipe parts for fabrication are required, and the use of the parts is great, leading to an increased cost. In addition, the process of brazing is troublesome, and assemblage is complicated and difficult because the number of portions to be brazed is significantly great, and the shape of the refrigerant pipes is complex. Further, a large space for connecting the pipes is required to use the refrigerant pipes in the form of complication to connect between the respective components, creating a problem wherein the outdoor unit has a large size as a whole.

SUMMARY OF THE INVENTION

It is an object of the present invention to eliminate the disadvantages of the conventional air conditioning apparatus and to provide a new and improved air conditioning apparatus capable of simplifying the arrangement of pipes in the outdoor unit, and of significantly reducing the volume of material for the pipes and the number of portions to be brazed, thereby lowering costs and raising reliability.

The foregoing and other objects of the present invention have been attained by providing an air conditioning apparatus including a pipe unit in the form of a block-like member; the pipe unit comprising: control components, like a four port valve, a two port valve and a check value, of the refrigerating cycle, which are incorporated in the block-like member; refrigerant passages which are formed in the block-like member to lead to the control components; and connecting ports which are formed in the block-like member to be connected to the essential components, like a compressor, and an indoor and an outdoor heat exchanger, of the refrigerating cycle. The pipe unit is preferably made of a material having low coefficient of heat transfer. The pipe unit is preferably provided with a heat transfer blocking structure which can reduce the area of heat transfer path between the hot refrigerant and the cold refrigerant. In addition, the pipe unit preferably has its outer surface covered with an insulating material.

As a result, the number of portions to be brazed can be significantly decreased. The refrigerant pipe arrangement can be simplified, facilitating the assemblage and improving the operating performance. The volume of material required for the pipes can be reduced, lowering costs. The refrigerant passages which lead to the control components of the refrigerating cycle can become unit and simplified, allowing the outdoor unit be small-sized. In addition, the significant decreased number of portions to be brazed can raise reliability.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Now, the present invention will be described in detail with reference to preferred embodiments illustrated in the accompanying drawings.

Figure 1:
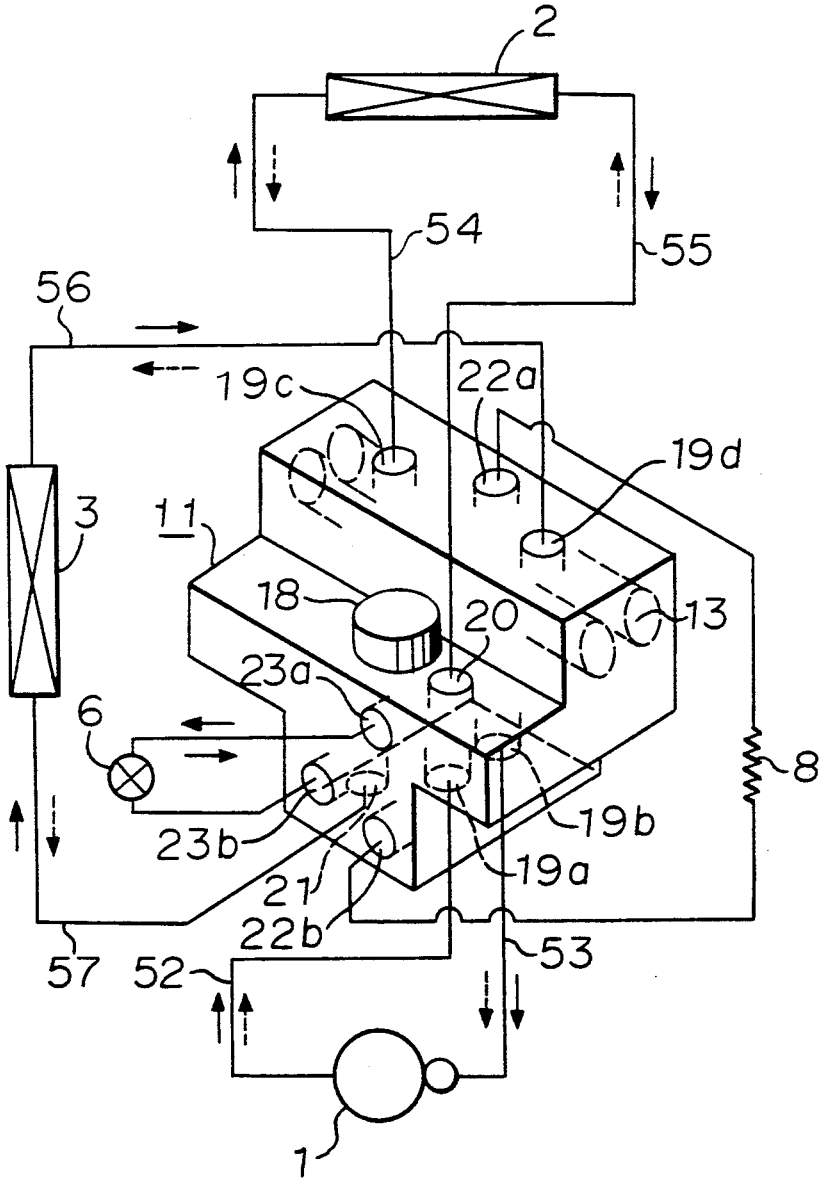
FIG. 1 is a diagram of the refrigerating cycle of an air conditioning apparatus wherein a block-like pipe unit is utilized in accordance with a first embodiment of the present invention.

Firstly, a first embodiment of the present invention will be explained. Referring to FIG. 1, there is shown the refrigerating cycle of the air conditioning apparatus using a pipe unit 11 according to the first embodiment of the present invention.

The air conditioning apparatus connects a compressor 1, a four port valve 13, an outdoor heat exchanger 2, a decompression device 6, and an indoor heat exchanger 3 to form the refrigerating cycle so that the refrigerating cycle returns to the compressor 1 through the four port valve 13. Switching the four port valve 13 allows the air conditioning apparatus to selectively carry out room cooling and room heating. The flow of a refrigerant on cooling is indicated in arrows of solid line, whereas the flow of the refrigerant on heating is indicated in arrows of dotted line.

Figure 2:
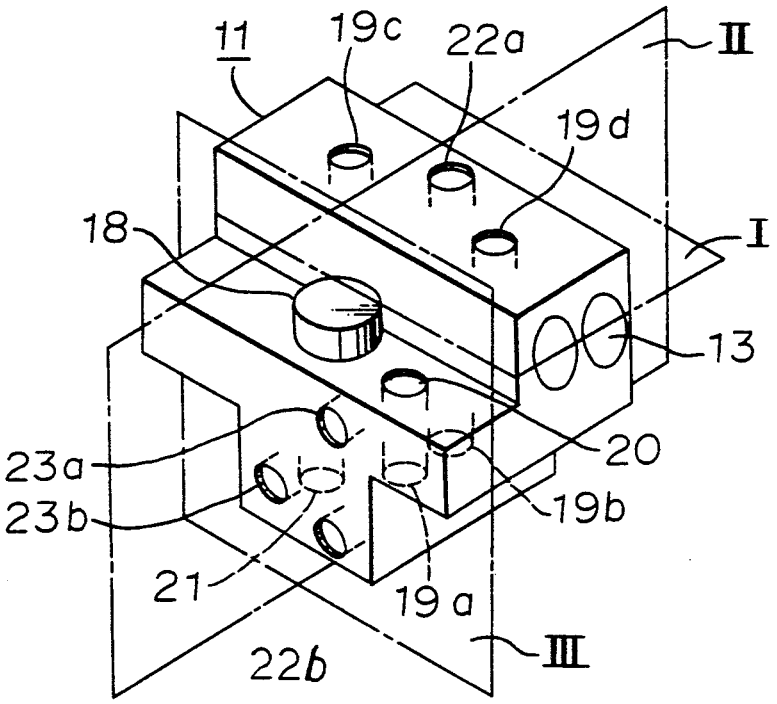
FIG. 2 is a perspective view of the pipe unit of FIG. 1.
Figure 3:
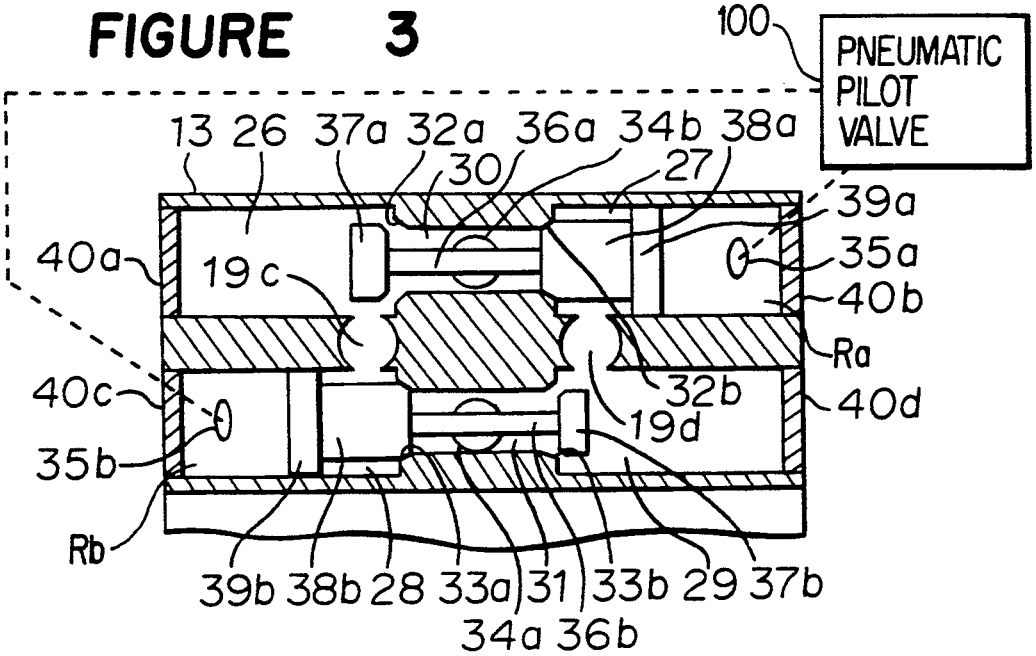
FIG. 3 is a cross-sectional view taken along the plane of I of FIG. 2.
Figure 4:
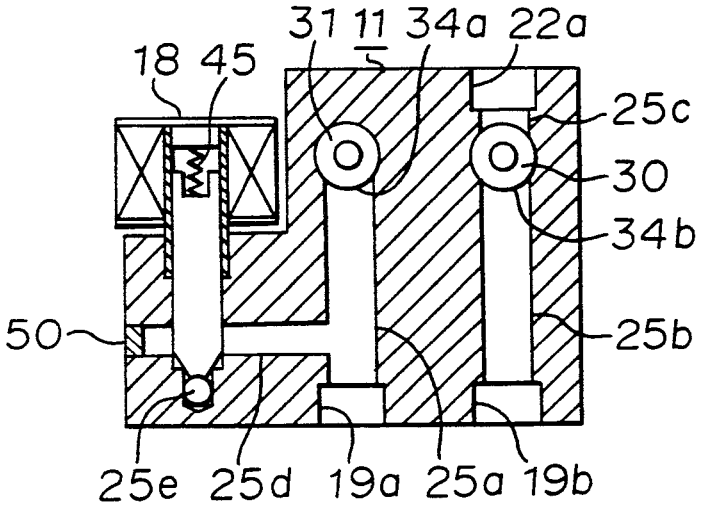
FIG. 4 is a cross-sectional view taken along the plane of II of FIG. 2.
Figure 5:
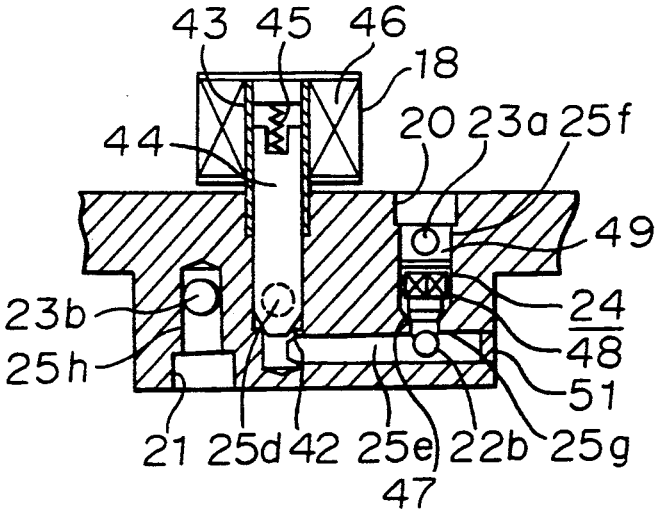
FIG. 5 is a cross-sectional view taken along the plane of III of FIG. 2.

FIG. 2 is a schematic perspective view showing the structure of the pipe unit 11 shown in FIG. 1. FIG. 3 is a cross-sectional view taken along the plane of I shown in FIG. 2. FIG. 4 is a cross-sectional view taken along the plane of II shown in FIG. 2. FIG. 5 is a cross-sectional view taken along the plane of III shown in FIG. 2. As shown in these Figures, the pipe unit 11 is constructed to include in a block member the four port valve 13, a two port valve 18 and a check valve 24 which are control components of the refrigerating cycle, refrigerant passages 25*a*, 25*b*, 25*c*, 25*d*, 25*e*, 25*f*, 25*g* and 25*h* which are used to lead to the control components, and connecting ports 19*a*, 19*b*, 19*c*, 19*d*, 20, 21, 22*a*, 22*b*, 23*a* and 23*b* which are used to connect other components. As shown in FIGS. 3 and 4, the pipe unit 11 includes four cylinders 26, 27, 28 and 29 so that the cylinder 26 and the cylinder 27 communicate through a communicating portion 30 with valve seats 32*a* and 32*b* at its opposed ends. The cylinder 28 and the cylinder 29 also communicate through a communicating portion 31 with valve seats 33*a* and 33*b* at its opposed ends. In the wall surface defining the communicating portion 30 is formed an opening 34*b* of the refrigerant passage 25*b* which communicates with the intake connecting port 19*b* to be connected to the intake tube of the compressor 1. In the wall surface defining the communicating portion 31 is formed an opening 34*a* of the refrigerant passage 25*a* which communicates with the discharge connecting port 19*a* to be connected to the discharge tube of the compressor 1. Between the cylinder 26 and the cylinder 28 is provided the outdoor connecting port 19*c* which communicates between the cylinders 26 and 28, and which is connected to the outdoor heat exchanger 2. Between the cylinder 27 and the cylinder 29 is provided the connecting port 19*d* which communicates between the cylinders 27 and 29, and which is connected to the indoor heat exchanger 3. In addition, in the wall surfaces of the cylinder 27 and the cylinder 28 are, respectively, formed openings 35*a* and 35*b* which communicate with a pilot valve 100. The pilot valve can switch the pressures in a room Ra defined by the sealing member 39*a* and the wall of the cylinder 27, and a room Rb defined by the sealing member 39*b* and the wall of the cylinder 28 to either one of a higher level and a lower level in order to establish either one of the following two selective connections:

(i) The connecting port 19*c* is connected to the refrigerant passage 25*a* which communicates with the discharge connecting port 19*a*, and the connecting port 19*d* is connected to the refrigerant passage 25*b* which communicates with the intake connecting port 19*b*.

(ii) The connecting port 19*c* is connected to the refrigerant passage 25*b* which communicates with the intake connecting port 19*b*, and the connecting port 19*d* is connected to the refrigerant passage 25*a* which communicates with the discharge connecting port 19*a*.

In the communicating portion 30 between the cylinders 26 and 27 is incorporated a connecting rod 36*a* which connects a valve 37*a*, and a valve 38*a* with a sealing member 39*a* at its end. In the communicating port, between the cylinders 28 and 29 is incorporated another connecting rod 36*b* which connects a valve 37*b*, and a valve 38*b* with a sealing member 39*b* at its end. The valves are actuated under differential pressures on the opposed surfaces of the sealing members caused by the actuation of the pilot valve, to selectively open and close the respective communicating portions 30 and 31, thereby establishing the communication between the connecting ports 19*a* and 19*c* and the communication between the connecting ports 19*b* and 19*d*, or the communication between the connecting ports 19*a* and 19*d* and the communication between the connecting ports 19*b* and 19*c*. In addition, as shown in FIG. 4, the refrigerant passage 25*c* is formed to communicate with the communicating portion 30 of the four port valve 13, and is provided at one end with the connecting ports 22*a* to be connected to a capillary tube. In FIG. 3, there are shown plugs 40*a*, 40*b*, 40*c* and 40*d*, each of which seals each one end of the cylinders 26, 27, 28 and 29.

The two port valve 18 is constructed as shown in FIGS. 4 and 5. Specifically, a valve seat 42 is formed in the pipe unit 11, and a plunger 44 is arranged to be movable toward and away from the valve seat 42 in a cylinder 43, constituting the two port valve 18. The plunger 44 also functions as a valve, and is constantly urged against the valve seat 42 by the spring force of a spring 45 which is arranged in the cylinder 43. In addition, the cylinder 43 is provided with a solenoid 46 which can function to withdraw the plunger 44 from the valve seat 42 against the spring force of the spring 45. Around the two port valve 18 are formed the refrigerant passages 25*d* and 25*e*, which can communicate with each other through the valve seat 42 when the plunger 42 is withdrawn from the valve seat 42. The refrigerant passage 25*d* joins the refrigerant passage 25*a* which communicates with the connecting port 19*a*, and the refrigerant passage 25*e* joins the refrigerant passage 25*g* in FIG. 5, which communicates with the check valve 24. Reference numerals 50 and 51, indicate plugs, each of which seals each one end of the refrigerant passages 25*d* and 25*e*, respectively.

The check valve 24 is constituted by a valve seat 47 between the refrigerant passage 25*f* and the refrigerant passage 25*e*, a valve 48, and a stopper 49 which restricts the movement of the valve 48 raised by a force caused by the flow of the refrigerant. The check valve functions to prevent the refrigerant from flowing back between the valve seat 47 and the valve 48. The refrigerant passage 25*g* joins the refrigerant passage 25*e*. The refrigerant passage 25*f* communicates with the connecting port 23*a* to be connected to the decompression device such as an expansion valve, and with the connecting port 20 to be connected to the outdoor heat exchanger 2. In addition, the pipe unit 11 includes the refrigerant passage 25*h* which communicates at its opposed ends with the connecting port 23*b* to be connected to the decompression device such as an expansion value, and with the connecting port 21 to be connected to the indoor heat exchanger 3, respectively.

Next, the connection to each connecting port of the pipe unit 11 will be described. In order to use the pipe unit 11 according to the present invention to constitute the refrigerating cycle, the discharge connecting port 19*a* of the pipe unit 11 is connected to a discharge pipe 52 of the compressor 1, and the intake connecting port 19*b* is connected to an intake pipe 53 of the compressor I. The outdoor heat exchanger 2 is connected to the connecting ports 19*c* and 20 of the pipe unit 11 through connecting pipes 54 and 55, respectively. The indoor heat exchanger 3 is connected to the connecting ports 19*d* and 21 of the pipe unit 11 through the connecting pipes 56 and 57, respectively. In addition, to the connecting ports 22*a* and 22*b*, and the connecting ports 23*a* and 23*b* of the pipe unit 11 are connected a capillary tube 8 and the decompression device 6 such as an expansion valve, respectively.

Although in the embodiment as previously explained the pipe unit 11 includes the four port valve 13, the two port valve 18 and the check valve 24 which are control components of the refrigerating cycle, and is provided with the connecting ports which are used to connect between the refrigerant passages for the control components and the essential components of the refrigerating cycle, the pipe unit can be constructed to incorporate the decompression device such as an expansion valve and refrigerant passages for the decompression device. Specific structures of the four port valve, the two port valve and the check valve in the first embodiment are not necessarily limited to the ones as shown.

Figure 13:
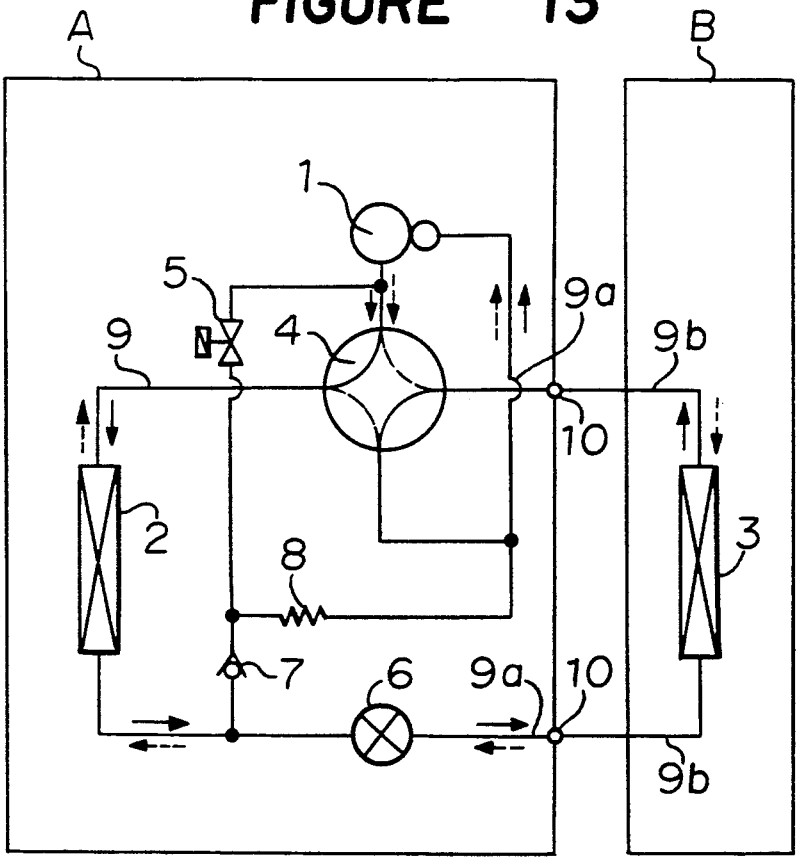
FIG. 13 is a diagram of the refrigerating cycle of an conventional air conditioning apparatus.
Figure 14:
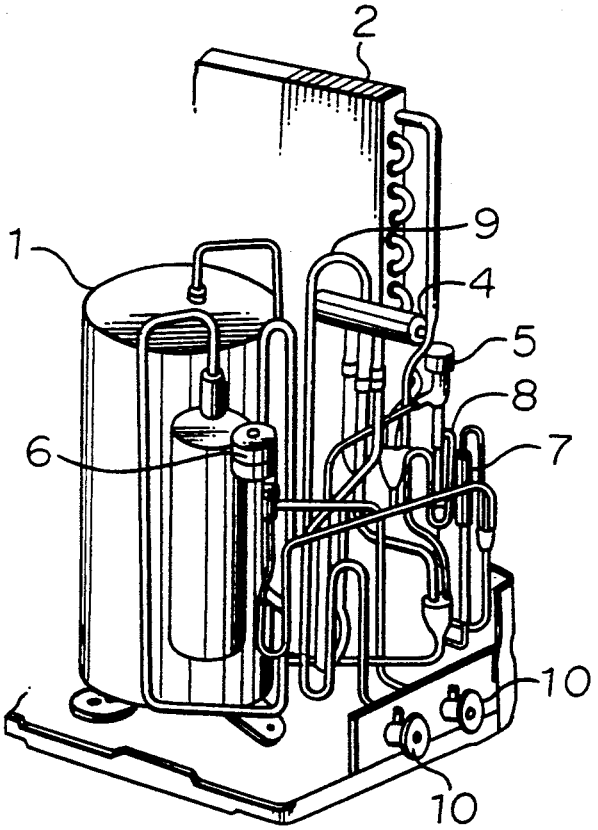
FIG. 14 is a perspective view of a part of the outdoor unit of the conventional air conditioning apparatus.

The operation of the air conditioning apparatus of the present invention is identical to that of the conventional device of FIG. 13, except that the movement of the valves 37 and 38 of the four-port valve 13 is accomplished by the application of fluid pressure to the sealing members 39*a* and 39*b* via the openings 35*a* and 35*b*, respectively. These openings are selectively supplied with fluid pressure via pilot valves in a well known manner.

More specifically, in a heating cycle pressurized refrigerant from the compressor 1 goes through the port 19*a*, through the refrigerant passage 25*a* (FIG. 4) and to the opening 34*a* (FIG. 3). From there, it flows past the open valve 37*b* to the port 19*d*, from which it reaches the indoor heat exchanger 3 via the connecting pipe 56.

After heat exchange and condensation in the indoor heat exchanger 3, the refrigerant is introduced through port 21 via the connecting pipe 57. From port 21, it is delivered via the refrigerant passage 25*h* (FIG. 5) to the port 23*b* leading to the decompression valve 6. From the decompression valve 6, the refrigerant is returned to the port 23*a*, from which it is discharged to the port 20 (FIG. 5), and from there to the outdoor heat exchanger via the connecting pipe 55.

After heat exchange and evaporation in the outdoor heat exchanger 2, the refrigerant is returned to the port 19*c* via the connecting pipe 54 and flows past the valve 37*a* (FIG. 3) to the refrigerant passage 25*b* via the opening 34*b*. From there, the refrigerant is discharged through the port 19*b* and returned to the compressor 1 via the connecting pipe 53.

The valves 37*a* and 37*b* are held in the open states shown in FIG. 3 by pneumatic fluid pressure applied through the openings 35*a* and 35*b*, and pressing on the sealing members 39*a* and 39*b*. The fluid pressure is delivered to the openings 35*a* and 35*b* via a pneumatic pilot valve 100, which may be a solenoid operated pilot valve of the type shown in U.S. Pat. No. 3,196,896. The solenoid of the pilot valve 100 may be controlled in a conventional manner such as is described for controlling the four way valve in U.S. Pat. No. 4,709,554.

In the case of a defrosting operating during a heating cycle, the plunger 44 of the two port valve 18 is raised by the solenoid 46 so that the refrigerant in the refrigerant passages 25*a* and 25*d* can flow through the refrigerant passage 25*e* and past the check valve 24. From there the refrigerant flows through the port 20 and the outdoor heat exchanger 2, thereby by-passing the indoor heat exchanger 3. Moreover, refrigerant from the outdoor heat exchanger can recirculate via a loop in which it travels from the port 22*a*, past the capillary tube 8 and to the port 22*b* (FIG. 5).

In order to switch from a heating cycle to a cooling cycle, the valves 37*a* and 37*b* are closed, and the valves 38*a* and 38*b* are opened, by the pneumatic pilot valve 100 under the control of a conventional controller such as that used in U.S. Pat. No. 4,709,554. Then, refrigerant reaching the opening 34*a* via the port 19*a* instead flows past the valve 38*b* to the port 19*c*, and therefore reaches the outdoor heat exchanger 2. From the outdoor heat exchanger it is returned via the connecting pipe 55 to the port 20, and past the decompression device 6 via the ports 23*a* and 23*b* (FIGS. 1 and 5). There, the refrigerant is delivered to the indoor heat exchanger 3 via the port 21, the connecting pipes 57 and 56, and the port 19*d*. From port 19*d*, it flows past the valve 38*a* to the opening 34*b*, the refrigerant passage 25*b* and the port 19*b*, after which it is returned to the compressor.

Figure 6:
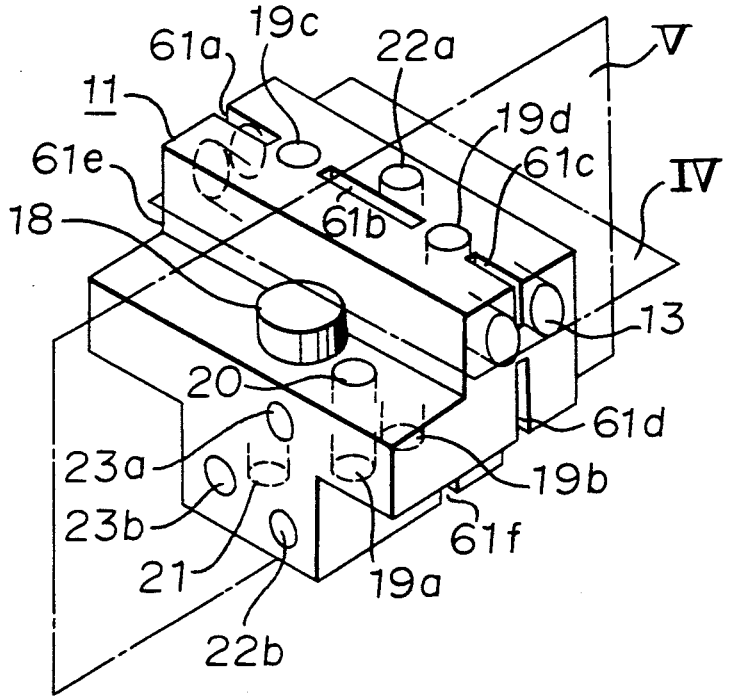
FIG. 6 is a perspective view of the pipe unit in a second embodiment.
Figure 7:
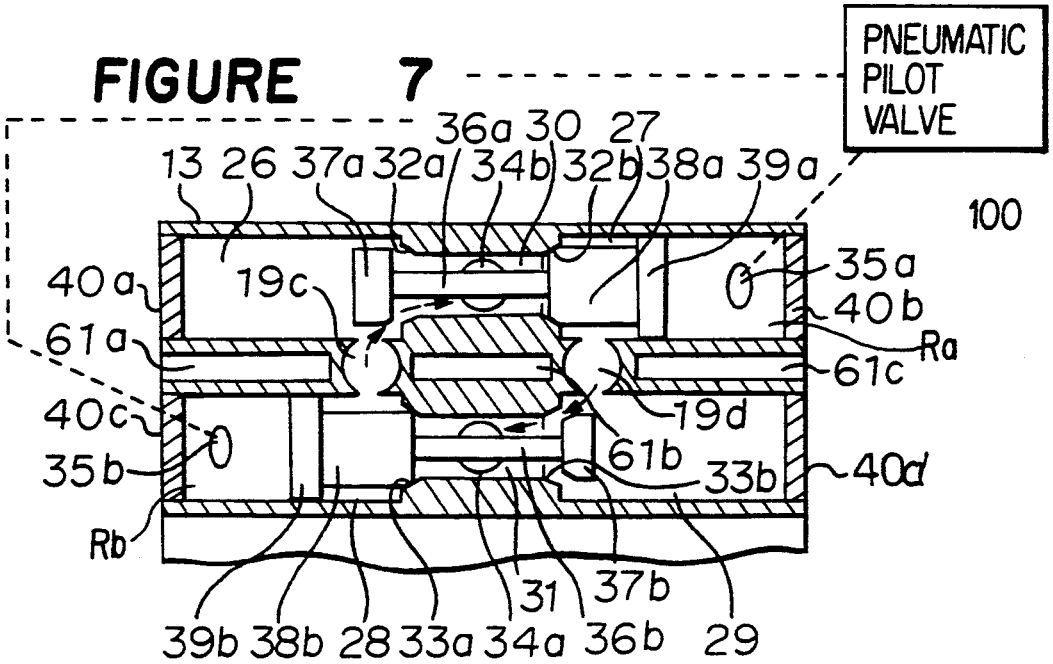
FIG. 7 is a cross-sectional view taken along the plane of IV of FIG. 6.
Figure 8:
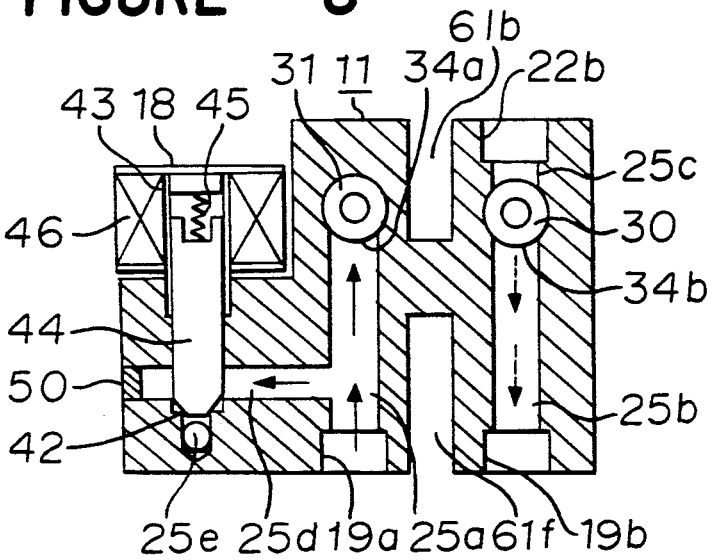
FIG. 8 is a cross-sectional view taken along the plane of V of FIG. 6.

A second embodiment of the present invention will be described in detail, referring to FIG. 6 which is a perspective view showing the structure of the pipe unit of the second embodiment. In the second embodiment, the pipe unit is provided with a heat transfer blocking structure which can reduce the quantity of heat leak between the hot refrigerant in the discharge line and the cold refrigerant in the intake line, both refrigerants flowing in an adjoining condition through the pipe unit. FIG. 7 is a cross-sectional view taken along the plane of IV of FIG. 6. FIG. 8 is a cross-sectional view taken along the plane of V of FIG. 6.

Only the difference between the second embodiment and the first embodiment will be described in detail. Reference numerals 61*a*, 61*b*, 61*c*, 61*d* and 61*e* designate spaces which are provided by forming recessed portions around the four port valve 13 incorporated in the pipe unit 11. Reference numeral 61*f* designates another space which is provided in an similar manner between the hot refrigerant passage of the discharge line and the cold refrigerant passage of the intake line, both passages being arranged to be adjacent each other.

The flow of the hot refrigerant in the discharge line on heating is indicated in arrows of solid line, and the flow of the cold refrigerant in the discharge line is indicated in arrows in dotted line in FIG. 7.

As shown in FIGS. 7 and 8, the pipe unit having the structure of the second embodiment has the spaces as explained. As a result, the heat transfer area between the respective portions separated by these spaces can be decreased in addition to the lengthened heat transfer path, reducing the quantity of heat leak from the hot refrigerant to the cold refrigerant in the pipe unit.

Figure 9:
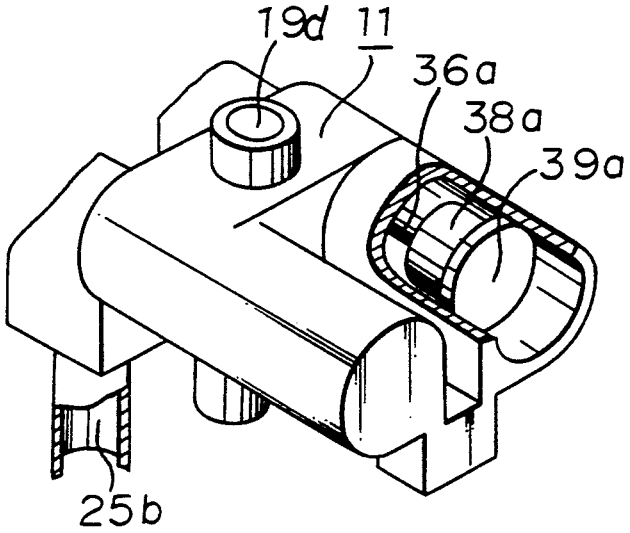
FIG. 9 is a perspective view, partially in section, of the pipe unit in a third embodiment.

A third embodiment will be described in detail, referring to FIG. 9 wherein the pipe unit is provided with a more preferable heat transfer blocking structure. The walls of the members which form the control components such as the four port valve, the two port valve and the check valve, the refrigerant passages for the control components and the connecting ports are thinned. Thinning the walls allows the heat transfer area between the respective portions to be uniformly reduced in comparison with the second embodiment, preventing the heat transfer from the hot refrigerant to the cold refrigerant more effectively.

Figure 10:
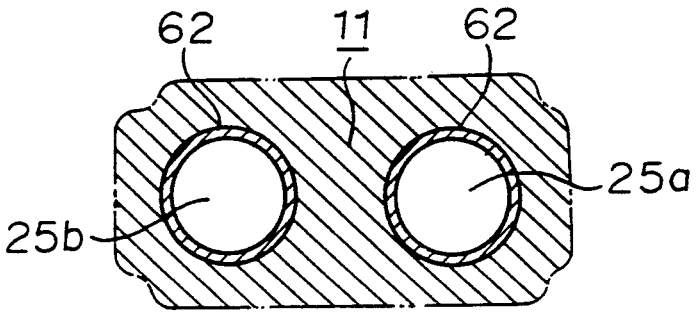
FIG. 10 is a cross-sectional view of the refrigerant passages in the pipe unit in a forth embodiment.

A fourth embodiment of the present invention will be described, referring to FIG. 10. The pipe unit of the forth embodiment has the heat transfer blocking structure wherein the inner circumferential wall surface of the respective refrigerant passages formed in the pipe unit is coated with a layer 62 of synthetic resin having low coefficient of heat transfer, such as polytetrafluoroethylene commercially available under the trade mark "Teflon". This structure can effectively prevent the heat transfer from the hot refrigerant in the discharge line to the cold refrigerant in the intake line because the coefficient of heat transfer of "Teflon" is as very small as about 0.2 kcal/m.h.°C.

Figure 11:
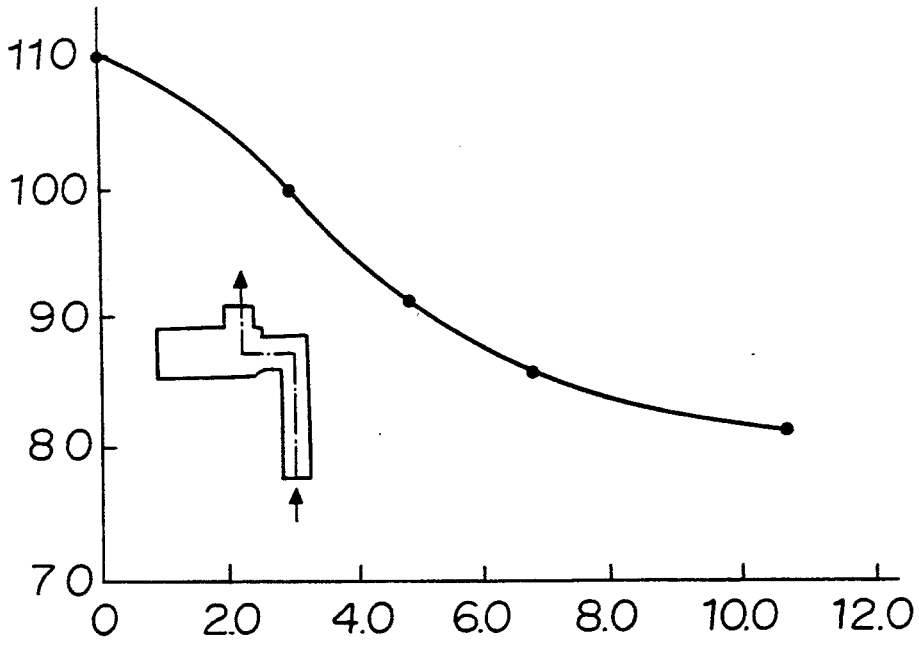
FIG. 11 is a graph of the temperature of refrigerant in the discharge line.

Now, the temperature at locations away from the inlet of the discharge line of the pipe unit made of brass will be explained, referring to FIG. 11 which is a graph of the temperature of the refrigerant at locations which are away from the inlet of the discharge line of the pipe unit at intervals on room heating under certain conditions. Because the coefficient of heat transfer of brass is as extremely high as about 100 kcal/m.h.°C., the quantity of heat leak from the hot refrigerant to the cold refrigerant in an adjoining state in the pipe unit, and the quantity of heat loss lost by radiation and convection between the pipe unit and air around the pipe unit are significantly great, and the temperature difference between the inlet and the outlet of the discharge line is as much as about 28° C.

On the other hand, the coefficiency of heat transfer of carbon steel is about 40 kcal/m.h.°C., and is about 40% of that of brass. In addition, carbon steel has greater strength than brass, which allows the wall forming the control components and the refrigerant passages to be thinned, reducing heat transfer areas. In practice, the coefficient of heat transfer of the material which is used to form the pipe unit according to the present invention is preferably not higher than 45 kcal/m.h.°C. Using such material causes the quantity of heat leak from the hot refrigerant in the discharge line to the cold refrigerant in the intake line to be reduced. More preferable material is stainless steel whose coefficient of heat transfer is 13 kcal/m.h.°C. Using stainless steel as the material can prevent the heat transfer to the cold refrigerant in the intake line in a more effective manner.

Figure 12:
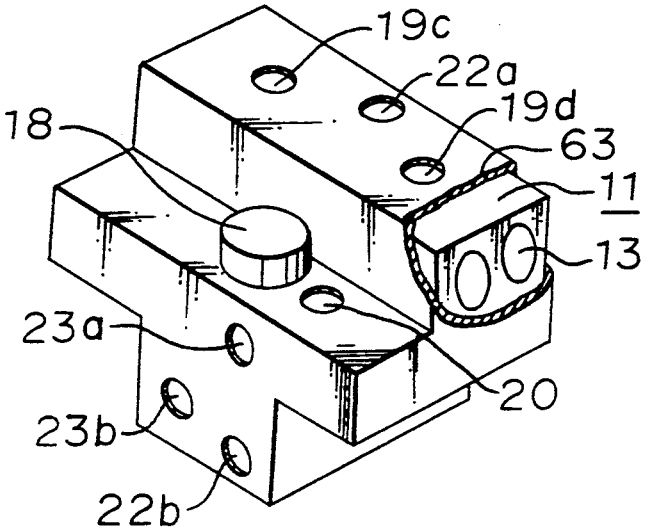
FIG. 12 is a perspective view, partially in section, of the pipe unit in a fifth embodiment.

A fifth embodiment of the present invention will be explained, referring to FIG. 12 which is a perspective view, partially in section, of the pipe unit structure of the fifth embodiment. In the fifth embodiment, the pipe unit has its outer surface covered with an insulating material 63 such as styrene foam. This structure can prevent heat transfer between the pipe unit and air around the unit, and decrease heat loss in the discharge refrigerant, improving heating output in particular.

The operation of the second through fifth embodiments is the same as in the first embodiment.

Obviously, numerous modifications and variations of the present invention are possible in light of the above teachings. It is therefore to be understood that within the scope of the appended claims, the invention may be practiced otherwise than as specifically described herein.

What is claimed is:

1. An air conditioning apparatus including a pipe unit in the form of a block-like member, the pipe unit comprising:

control components, including a four port valve, a two port valve and a check valve, of the refrigerating cycle, which are incorporated in the block-like member;

refrigerant passages which are formed in the block-like member to lead to the control components; and connecting ports which are formed in the block-like member to be connected to essential components, like a compressor, and an indoor and an outdoor heat exchanger, of the refrigerating cycle.

2. An air conditioning apparatus according to claim 1, wherein the pipe unit has a heat transfer blocking structure which can reduce the quantity of heat leak from the hot refrigerant in the discharge line to the cold refrigerant in the intake line.

3. An air conditioning apparatus according to claim 2, wherein the heat transfer blocking structure is of a space which is formed in the block-like member at a location between the discharge line and the intake line adjoining to the discharge line.

4. An air conditioning apparatus according to claim 2, wherein the heat transfer blocking structure is of thinned walls of portions which form control components constituting the discharge line and the intake line, and refrigerant passages and connecting ports for the control components.

5. An air conditioning apparatus according to claim 2, wherein the heat transfer blocking structure is of a layer of synthetic resin having low coefficient of heat transfer, the layer being coated on at least the inner wall surfaces of the control components and the refrigerant passages.

6. An air conditioning apparatus according to claim 1, wherein the pipe unit is made of stainless steel, carbon steel or the like, which has coefficient of heat transfer of not higher than 45 Kcal/m.h.°C.

7. An air conditioning apparatus according to claim 1, wherein the pipe unit has its outer surface covered with an insulating material like styrene foam.

* * * * *